US007086530B2

(12) United States Patent
Price et al.

(10) Patent No.: US 7,086,530 B2
(45) Date of Patent: Aug. 8, 2006

(54) SAFETY HOLDERS FOR FIREWORKS

(76) Inventors: James E. Price, 936 S. Market St., Galion, OH (US) 44833; Richard D. Spree, 21 Mohican Trail, Lexington, OH (US) 44904

( * ) Notice: Subject to any disclaimer, the term of this patent is extended or adjusted under 35 U.S.C. 154(b) by 10 days.

(21) Appl. No.: 10/803,523

(22) Filed: Mar. 17, 2004

(65) Prior Publication Data

US 2004/0217020 A1 Nov. 4, 2004

Related U.S. Application Data

(60) Provisional application No. 60/456,154, filed on Mar. 20, 2003.

(51) Int. Cl.
*B65D 73/00* (2006.01)
*F42B 4/00* (2006.01)

(52) U.S. Cl. ..... 206/477; 206/3; 102/358; 248/510; 248/346.03

(58) Field of Classification Search ..... 206/3, 206/446, 477, 478, 480, 486, 805; 24/326, 24/327, 455, 457, 483, 484, 18, 17 A, 17 R, 24/563; 102/343, 349, 358; 211/8, 70.1, 211/72, 73; 269/1, 2, 95, 97, 98; 248/510, 248/346.01, 346.03, 346.06, 346.07

See application file for complete search history.

(56) References Cited

U.S. PATENT DOCUMENTS

| | | | | |
|---|---|---|---|---|
| 1,816,399 | A * | 7/1931 | Rohwedder | 426/124 |
| 2,129,039 | A * | 9/1938 | Schooley | 102/358 |
| 2,795,387 | A * | 6/1957 | Elsey | 248/520 |
| 4,771,695 | A * | 9/1988 | Simpson | 102/343 |
| 5,028,023 | A * | 7/1991 | Allen | 248/152 |
| D384,459 | S * | 9/1997 | Eisenman | D32/61 |
| 6,527,245 | B1 * | 3/2003 | Graves et al. | 248/518 |

FOREIGN PATENT DOCUMENTS

FR 2722780 A1 * 1/1996

OTHER PUBLICATIONS

Photocopy of BLACK CAT® Safety Shooter Base packaging with instructions and two views of product, document is undated but inventor believes the document is older than Mar. 19, 2003.

Photographs of BLACK CAT® Safety Shooter Base—5 pages—product is undated but inventor believes the product is older than Mar. 19, 2003.

* cited by examiner

*Primary Examiner*—Mickey Yu
*Assistant Examiner*—J. Gregory Pickett
(74) *Attorney, Agent, or Firm*—Zollinger & Buclesan Ltd

(57) ABSTRACT

A holder for fireworks includes a body having first and second portions that are movable with respect to each other between clamped and unclamped positions. A retaining device is used to hold the portions in the clamped position against a firework. The holder may be collapsed to a flat configuration for storage and shipping.

17 Claims, 9 Drawing Sheets

SAFETY HOLDERS FOR FIREWORKS

CROSS REFERENCE TO RELATED APPLICATIONS

This application claims priority from U.S. Provisional Application Ser. No. 60/456,154 filed Mar. 20, 2003; the disclosures of which are incorporated herein by reference.

BACKGROUND OF THE INVENTION

1. Technical Field

The present invention generally relates to devices that hold fireworks in a proper position while the fireworks are ignited. Specifically, the present invention relates to a safety holder that may be used with a multiple shot firework or a rocket-type firework.

2. Background Information

Devices for safely igniting fireworks are generally desired in the art because they reduce personal injuries and property damage. One particular area of concern is multiple-shot fireworks that shoot one star burst after another into the air until the firework is spent. A problem with this type of firework is that the launch of an initial star burst can undesirably reposition the firework causing the next star burst to be fired in an unintended direction.

Most multiple shot fireworks are in the form of a plurality of side-by-side vertical tubes or a long single tube such as the traditional roman candle. These multiple shot fireworks are sold in a wide variety of sizes and configurations. Those who ignite these types of fireworks desire a holder that is able to accommodate the wide variety of sizes and shapes for these fireworks.

Another problem is that people who ignite fireworks like to take the fireworks to different places. A safety holder should thus be portable so that the person does not find it bothersome to use in different locations. The safety holder should also be inexpensive enough to not deter people from purchasing the holder. One known device sold under BLACK CAT® Safety Shooter Base trademark is shown in the photographs and photocopies submitted with the Information Disclosure Statement. This device may be erected from a flat storage position but does not provide the range of adjustability desired in the art.

BRIEF SUMMARY OF THE INVENTION

The present invention provides a safety holder for fireworks. The safety holder is adjustable and may be used with fireworks of different sizes and shapes. The adjustability is accomplished by providing a holder having two opposed portions that move with respect to each other. A retaining device such as a clamp cord is used to maintain the clamped position against a firework.

Another aspect of the invention allows the holder to be collapsed to a substantially flat condition. The invention may also be erected without the use of connectors or tools. This feature allows the holder to be sold, transported, and stored in a collapsed condition.

The invention provides one embodiment that is used with thin, tube-shaped multiple shot fireworks and stick-based sky rockets. In this embodiment, a plurality of tubes are carried at the end of an elongated mount with the tubes being adapted to hold these types of fireworks.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
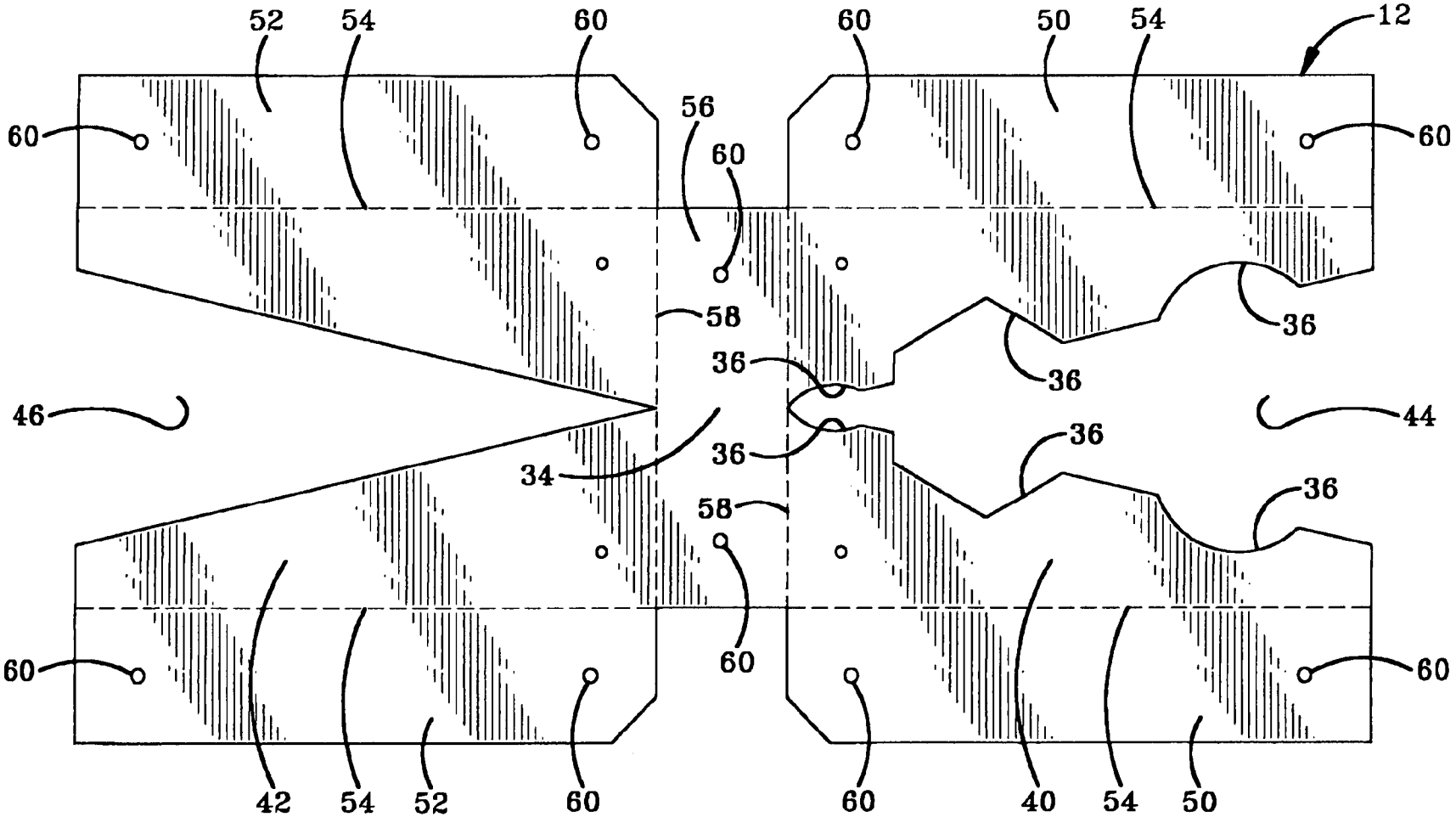
FIG. 1 is a top plan view of the first embodiment of the safety holder in a collapsed condition.
Figure 3:
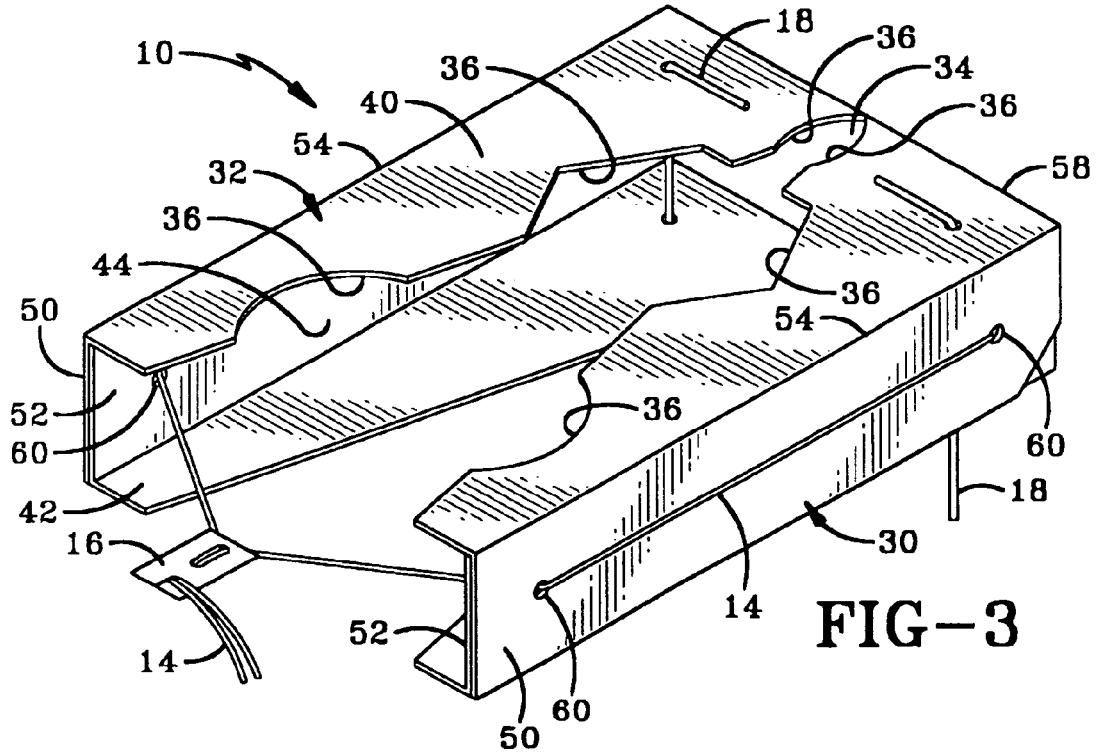
FIG. 3 is a perspective view of the holder in an assembled condition.
Figure 4:
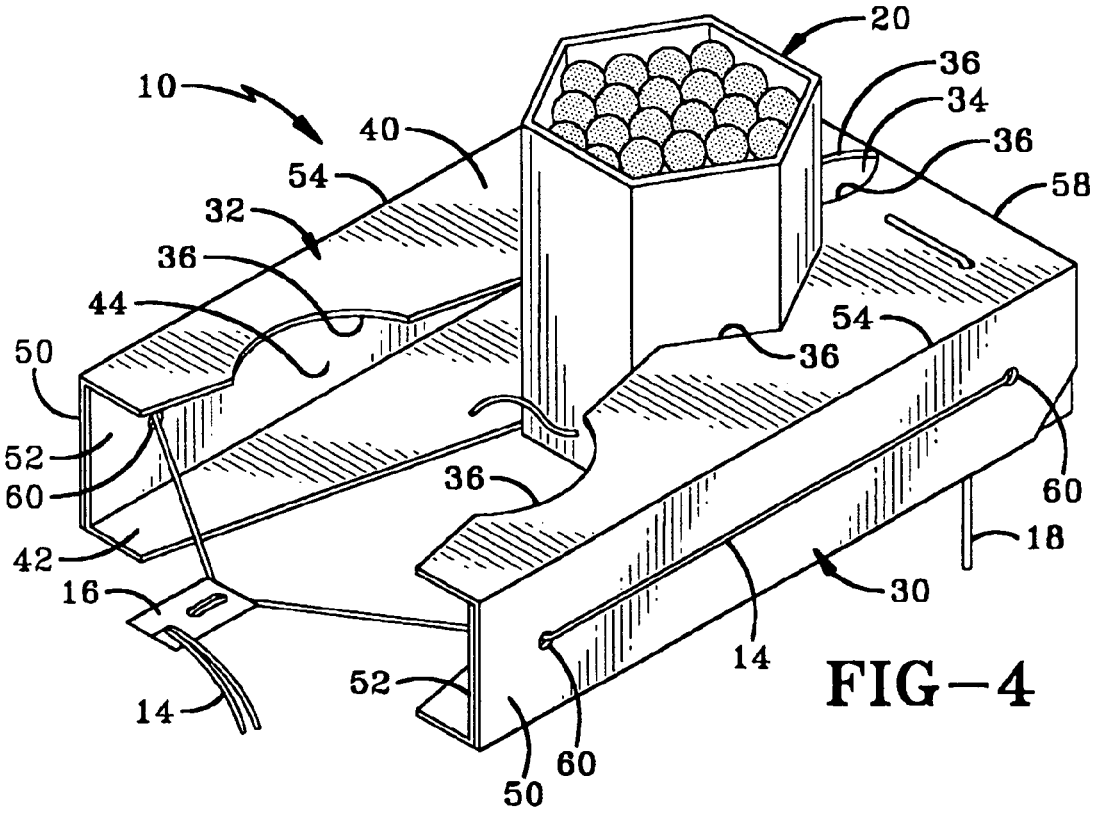
FIG. 4 is a perspective view of the holder clamped on a first size multiple shot firework.
Figure 5:
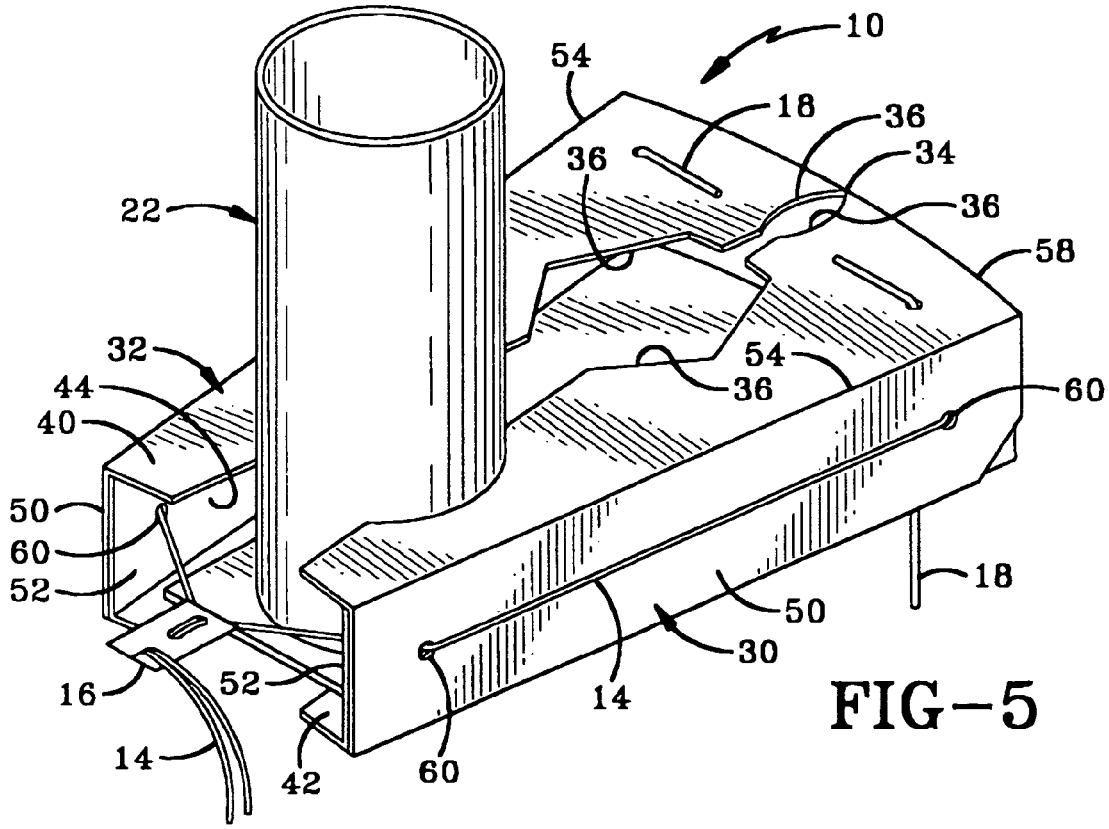
FIG. 5 is a perspective view of the holder clamped on a second size multiple shot firework.

The first embodiment of the safety holder of the present invention is indicated generally by the numeral 10 in the accompanying drawings. Safety holder 10 may be provided in a collapsed condition as shown in FIG. 1. The user may purchase holder 10 and erect holder 10 to the erected position shown in FIG. 3 without any tools or special connectors. Holder 10 generally includes a blank body 12 and a retaining device that holds body 12 clamped against the firework. In one embodiment, holder 10 includes a kit in the form of blank body 12, a clamp cord 14, a cord lock 16, and a ground anchor 18 that may be assembled into erected holder 10 as shown in FIG. 3. Once erected, holder 10 is adjustable so that it may be used to holder a variety of different-sized fireworks 20 and 22 as shown in FIGS. 4 and 5. Holder 10 may be clamped against fireworks 20 and 22 while providing a wide, sturdy base that helps prevent fireworks 20 and 22 from tipping over.

Figure 6:
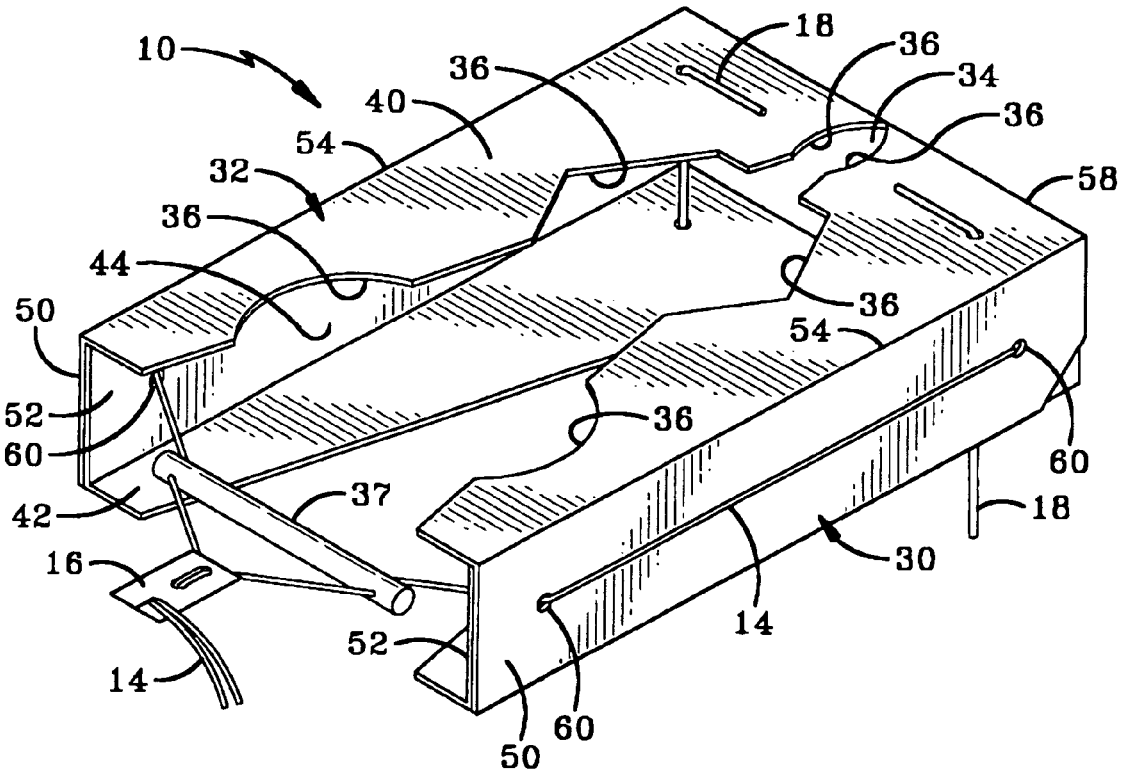
FIG. 6 is a perspective view of the holder with an alternative view of the retaining device.

When erected, holder 10 includes a first portion 30 and a second portion 32 that pivot with respect to each other about a living hinge 34. Portions 30 and 32 may be pulled toward each other with a retaining device that may be in the form of a clamp cord 14 that is held in the clamped condition with cord lock 16. When in the clamped condition, clamp cord 14 will be in tension. Cord 14 may be a pair of cord portions or a single integral cord that extends around the body of holders 10. In FIG. 6, a bar 37 may be used as the cord lock to keep cord 14 in tension with or without cord lock 16. The retaining device may be provided in other forms such as tape or Velcro strips or other structures that can pull the first and second portions toward each other. Portions 30 and 32 defines a series of opposed notches 36 designed to seat fireworks 20 and 22. Notches 36 may be provided in different shapes and sizes as shown in FIG. 1 to accommodate different-sized fireworks. Notches 36 may be rounded or angular to grip different fireworks.

Blank body 12 includes a top panel 40 and a bottom panel 42 that may be formed from a cardboard material. The material may be printed with directions so that the user cannot misplace the directions. An appropriate fire retardant may also be added to the cardboard. Body 12 may also be fabricated from a plastic such as a corrugated polymer product. Other materials known to those of ordinary skill in the art may also be used. Each panel 40 and 42 defines a channel 44 and 46 with the edges of channel 44 defining notches 36. Channel 46 may have smooth sides and may be more narrow than channel 44 so that the firework may rest on top of panel 42. A pair of side flaps 50 and 52 extend from opposed sides of each panel 40 and 42. Side flaps 50 and 52 may be pivoted with respect to panels 40 and 42 about living hinges 54. Side panels 50 and 52 may be removed with the ends of panels 40 and 42 connected together to provide a rigid body for holder 10. A rear panel 56 connects panels 40 and 42 with living hinges 58. A portion of panel 56 acts as living hinge 34.

Figure 2:
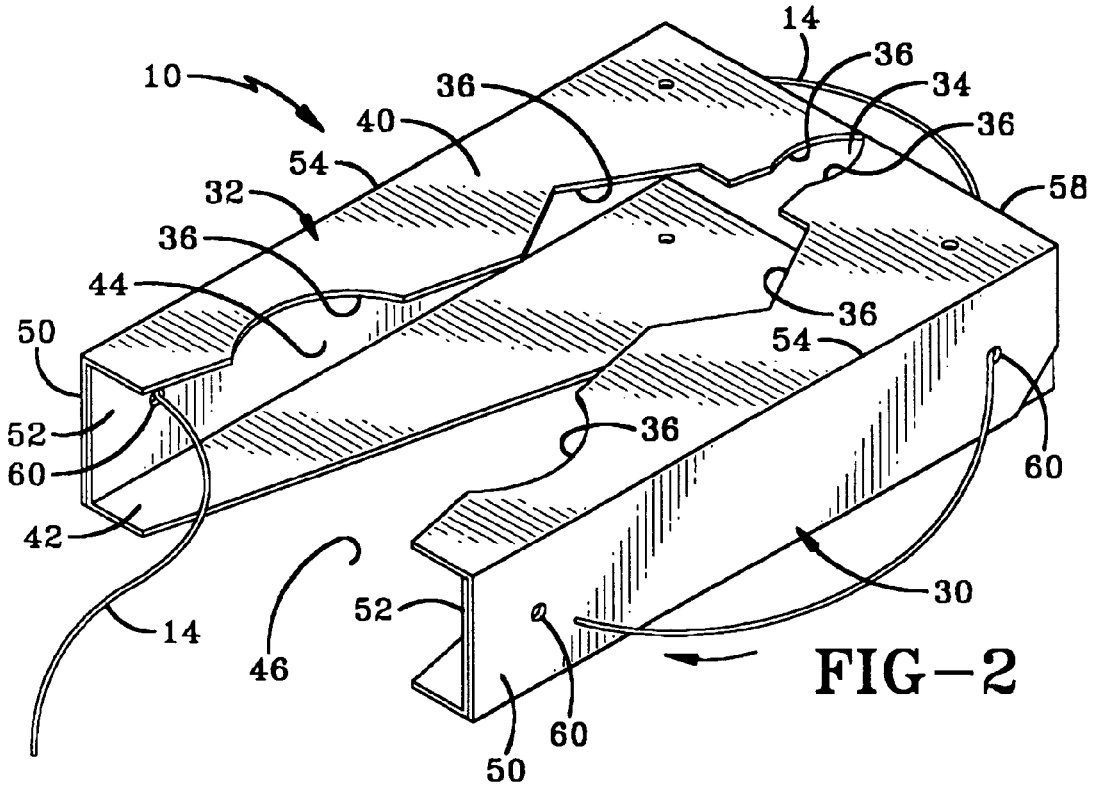
FIG. 2 shows a step of erecting the safety holder.

The user erects holder 10 by folding flaps 50 and 52 90 degrees to panels 40 and 42. The user than folds panels 40 and 42 to such that they are parallel as shown in FIG. 2 with flaps 50 and 52 being overlapped one inside the other. The user then threads clamp cord 14 through the openings 60 defined by flaps 50 and 52 as well as panel 56 with the loose ends of cord 14 being disposed at the front of holder 10. Cord 14 is threaded in the manner depicted in FIG. 3 such that cord 14 functions to hold flaps 50 and 52 together in the erected position. When other retaining devices are used, flaps 50 and 52 may be held together with other suitable connectors such as glue, snaps, Velcro, and the like. Cord 14 thus extends around body 12 and across hinge 34 to add rigidity to holder 10. Pulling the loose ends of cord 14 together causes halves 30 and 32 to pivot toward each other about hinge 34. A cord clamp 16 is used to lock the position of cord 14 with respect to portions 30 and 32. An optional L-shaped anchor 18 may be pushed through one of portions 30 and 32 into the ground to connect holder 10 to the ground.

The user places the firework 20 or 22 in between portions 30 and 32 and tightens clamp cord 14 to clamp firework 20 or 22 with portions 30 and 32. Firework 20 or 22 may sit on top of or under panel 42. Firework 20 or 22 may be placed in holder 10 with the fuse in the opening of holder defined by slots 44 and 46 so that the fuse may be easily lit. Firework 20 or 22 may then be ignited with little chance of firework 20 or 22 tipping over. Different-sized fireworks may be used simply by adjusting clamp cord 14. When the user is done, cord 14 may be removed and holder 10 may be return to its collapsed condition for storage and transport.

Figure 7:
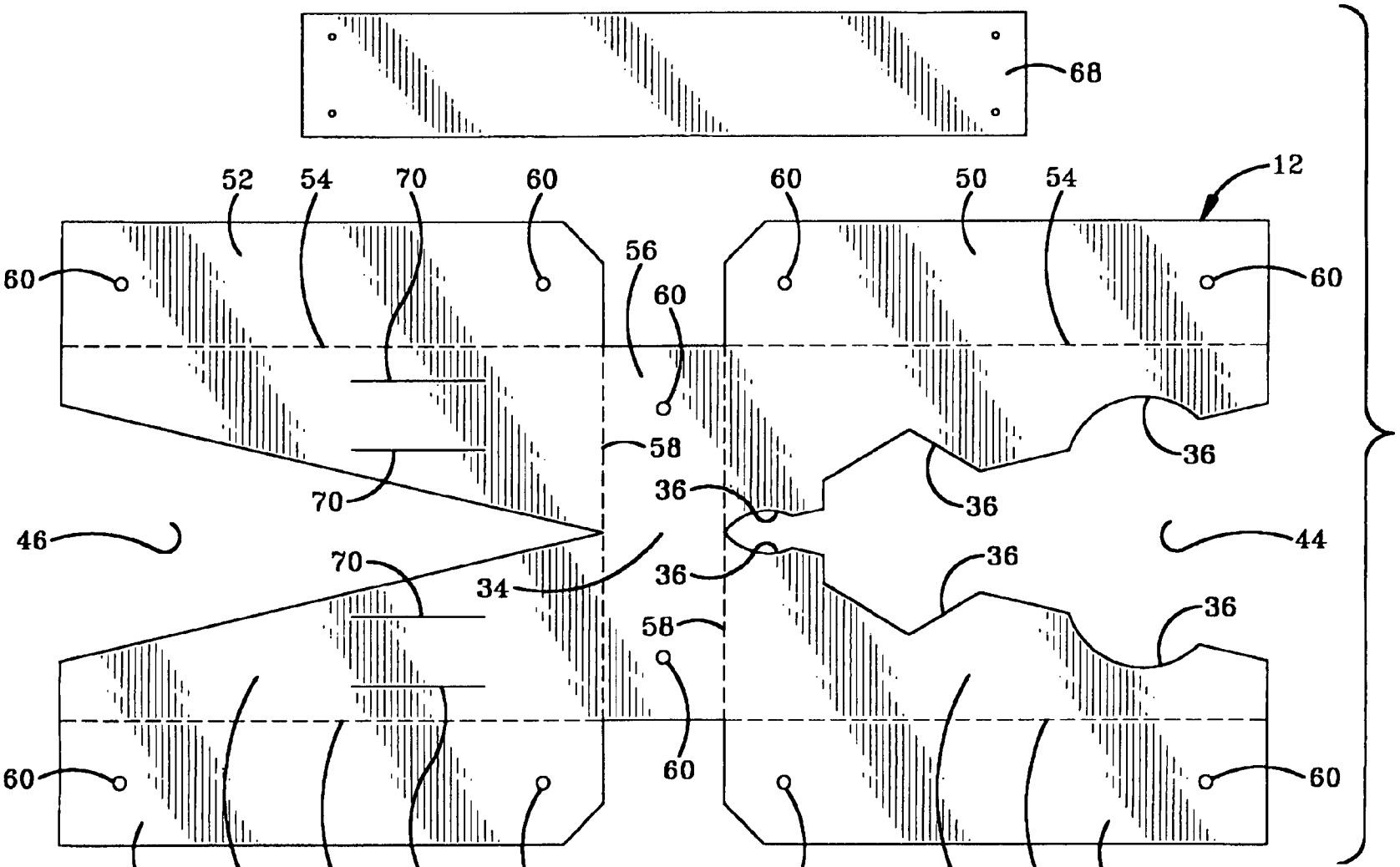
FIG. 7 is a top plan view of a second embodiment of the safety holder in a collapsed condition.
Figure 8:
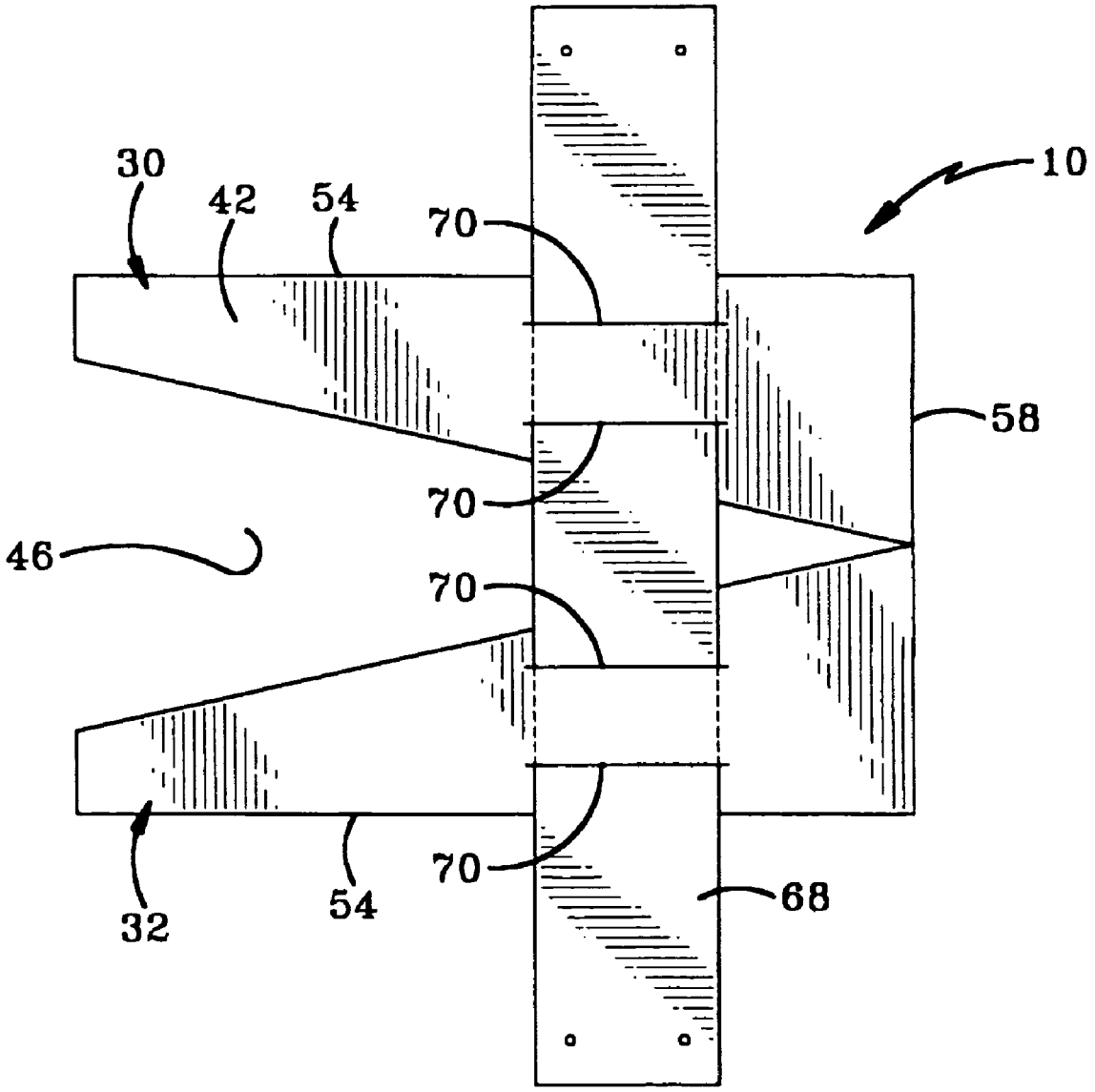
FIG. 8 is a bottom plan view of the second embodiment with the anchor in place.

The second embodiment of the invention is shown in FIGS. 7 and 8. In this embodiment, anchor 68 is in the form of an elongated strip that is woven through slits 70 defined by bottom panel 42 as shown in FIG. 8. Anchor 68 may be held to the ground with anchors 18. Anchor 68 has a length that is longer than the width of panel 42. Anchor 68 thus effectively increases the width of holders 10 and makes holder 10 more stable.

Figure 9:
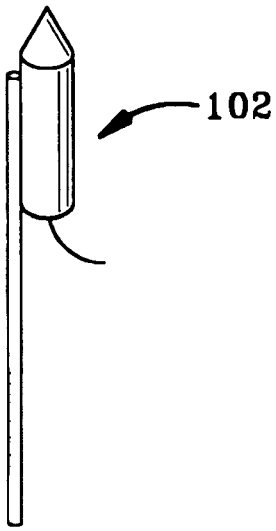
FIG. 9 is a perspective view of a typical sky rocket.
Figure 10:
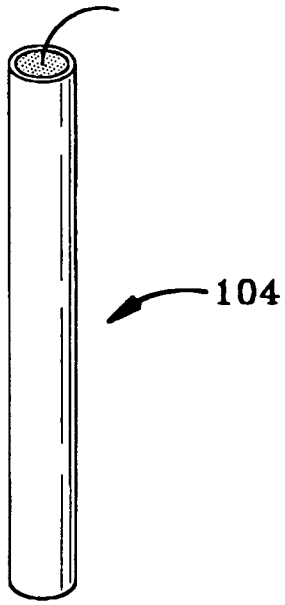
FIG. 10 is a perspective view of a typical roman candle.
Figure 11:
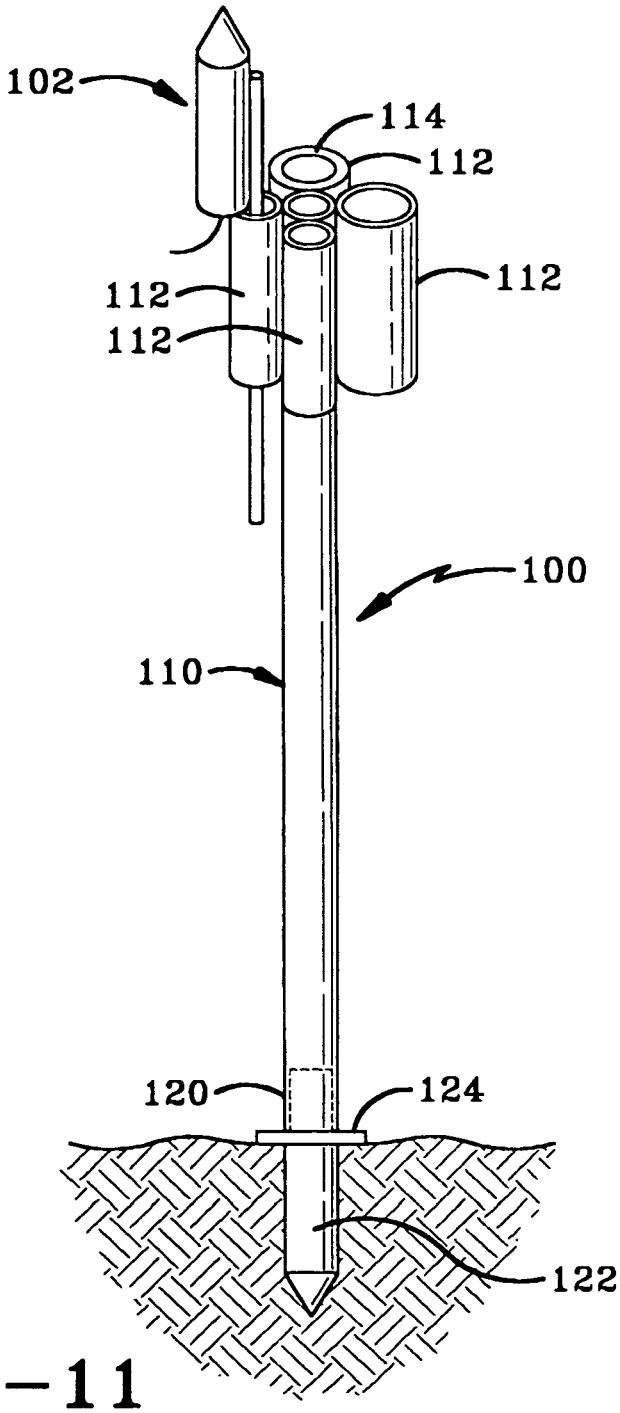
FIG. 11 is a perspective view of a third embodiment of the safety holder used to launch the sky rocket.
Figure 12:
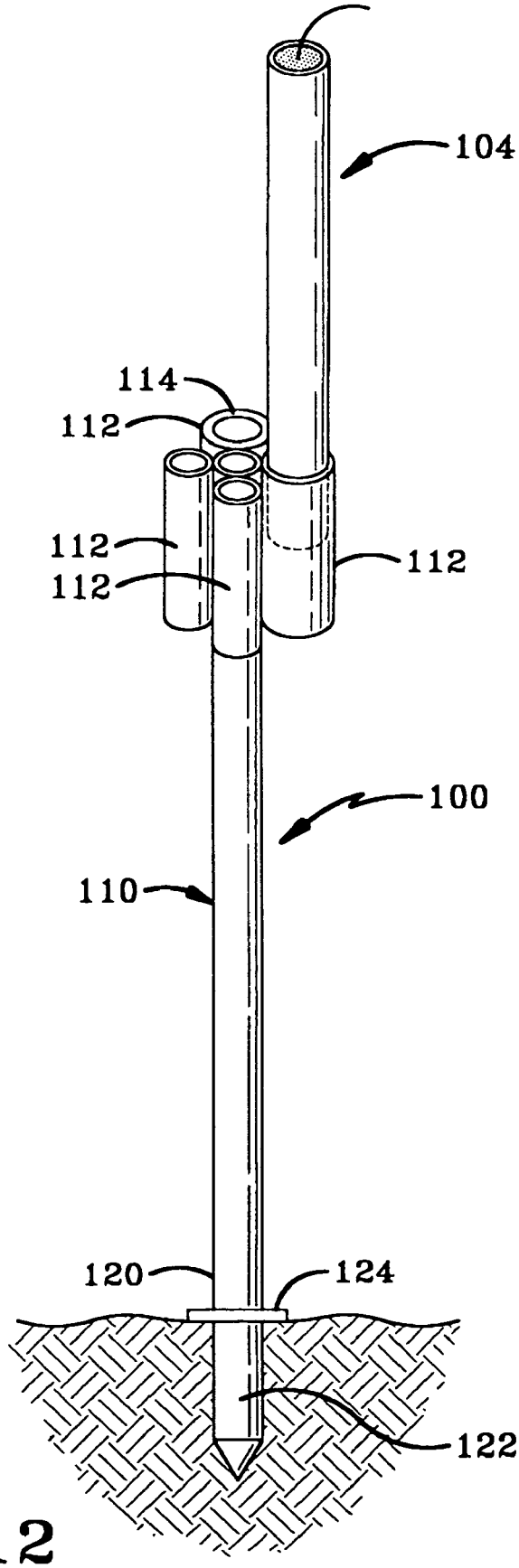
FIG. 12 is a perspective view of the third embodiment of the safety holder used to ignite a roman candle.
Figure 13:
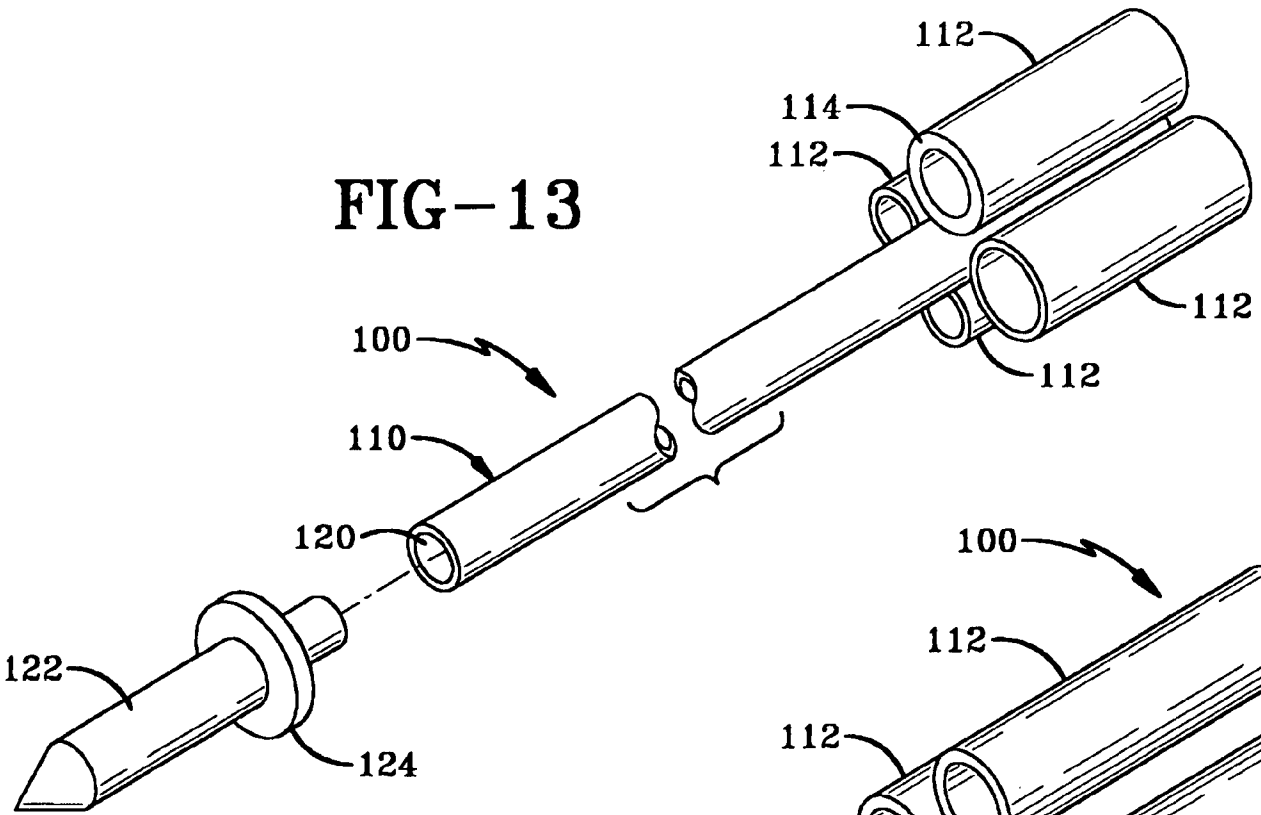
FIG. 13 is an exploded view of the third embodiment of the holder.
Figure 14:
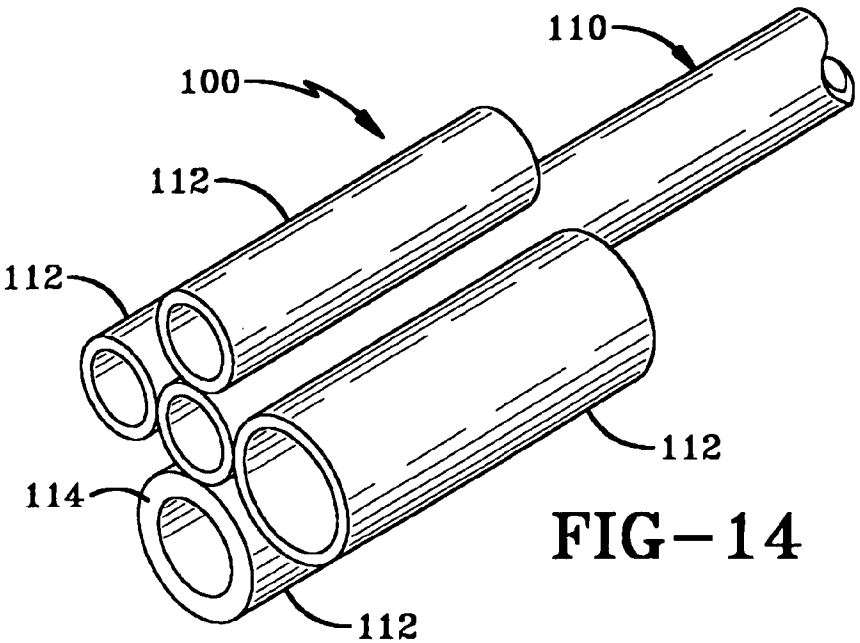
FIG. 14 is an enlarged view of the end of the third embodiment of the holder.

The third embodiment of the holder is indicated generally by the numeral 100 in FIGS. 9–14. Holder 100 is used is sky rockets 102 or roman candles 104 as shown in FIGS. 9 and 10. Holder 100 is securely anchored to the ground to prevent the fireworks from tipping over when ignited. Holder 100 includes an elongated mount 110 with a plurality of tubes 112 connected to the top end of mount 110. At least one of tubes 112 has a thick sidewall 114 to provide different-sized openings for different fireworks. Tubes 112 may have inside diameters of ¾ inch, ⅞ inch, 1 inch, and 1⅛ inch so that different fireworks may be securely held. Tubes 112 allow the sticks of sky rockets to slide through the tubes and allow the lower ends of roman candles to be frictionally held in place. In addition, small diameter (⅛ to ½ inch) for typical bottle rockets may be carried on the outside of tubes 112.

Mount 110 has a hollow lower end 120 that slides over a ground anchor 122 that has a stop flange 124. Ground anchor 122 may slide inside ¼ to ¾ the length of mount 110.

Holder 100 may thus be firmly anchored to the ground and will not tip over when a rocket is launched. A particularly bad problem in the art is that large sky rockets can cause a bottle to tip over allowing the sky rocket to launch horizontally. Holder 100 will not tip over. Holder 100 is also easily adjustable to launch the rockets in other directions.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A safety holder for holding a firework while the firework is ignited; the holder comprising:

a body having first and second opposed portions movable with respect to each other between an unclamped position where the firework may be positioned between the first and second portions and a clamped position where the firework is engaged by the first and second portions;

a retaining device connected to the body; the retaining device selectively holding the first and second portions in the clamped position against the firework;

an anchor selectively connected to the body; the anchor adapted to stabilize the body while the firework is being ignited; and the anchor extending from opposed sides of the body.

2. The holder of claim 1, wherein the retaining device includes first cord portion connected to the first portion of the body and a second cord portion connected to the second portion of the body; the cord portions being selectively connected together to hold the first and second body portions in the clamped position.

3. The holder of claim 2, wherein the first and second cord portions are connected together and extend around the body.

4. The holder of claim 3, wherein the first and second portions of the body define an opening adapted to allow the firework being inserted between the first and second body portions; the cord portions extending across the opening when connected together.

5. The holder of claim 2, further comprising a cord lock that holds the cord portions together.

6. The holder of claim 1, wherein the first and second body portions pivot between the clamped and unclamped positions.

7. The holder of claim 6, wherein the first and second body portions pivot about a living hinge.

8. The holder of claim 1, wherein the body defines at least two slits; the anchor disposed through the slits.

9. A safety holder for holding a firework while the firework is ignited; the holder comprising:

a body having first and second opposed portions movable with respect to each other between an unclamped position where the firework may be positioned between the first and second portions and a clamped position where the firework is engaged by the first and second portions;

a retaining device connected to the body; the retaining device selectively holding the first and second portions in the clamped position against the firework;

the body being configurable between an erected position that defines the first and second portions and a collapsed position where the body is flat; and the body including top and bottom panels connected together by a rear panel; each of the top and bottom panels having opposed sides; the body further including a plurality of side flaps; two of the side flaps extending from the opposed sides of the top panel and two of the side flaps extending from the opposed sides of the bottom panel.

10. The holder of claim 9, wherein the side flaps of the top panel overlap the side flaps of the bottom panel when the body is in the erected position.

11. A safety holder for holding a firework while the firework is ignited; the holder comprising:

a body having first and second opposed portions pivotable with respect to each other between an unclamped position where the firework may be positioned between the first and second portions and a clamped position where the firework is engaged by the first and second portions;

the body being configurable between an erected position that defines the first and second portions and a collapsed position where the body is flat;

the body including a top panel, a bottom panel, a rear panel, and a plurality of side flaps;

the top and bottom panels being connected to the rear panel with living hinges; and the rear panel defining a living hinge about which the first and second portions pivot between the clamped and unclamped positions.

12. The holder of claim 11, further comprising a retaining device connected to the body; the retaining device selectively holding the first and second portions in the clamped position against the firework.

13. The holder of claim 11, further comprising an anchor selectively connected to the body; the anchor adapted to stabilize the body while the firework is being ignited.

14. The holder of claim 13, wherein the bottom panel of the body defines at least two slits; the anchor disposed through the slits.

15. The holder of claim 13, wherein each of the top and bottom panels have opposed sides;

two of the side flaps extending from the opposed sides of the top panel and two of the side flaps extending from the opposed sides of the bottom panel; and the side flaps of the top panel overlap the side flaps of the bottom panel when the body is in the erected position.

16. The holder of claim 9, further comprising an anchor selectively connected to the body; the anchor adapted to stabilize the body while the firework is being ignited.

17. The holder of claim 16, wherein the bottom panel of the body defines at least two slits; the anchor disposed through the slits.

* * * * *